US006800181B1

(12) United States Patent
Accattato

(10) Patent No.: US 6,800,181 B1
(45) Date of Patent: Oct. 5, 2004

(54) DEVICE FOR CLEANING JEWELRY

(76) Inventor: Carlo L. Accattato, 72 Kennedy Dr., West Haverstraw, NY (US) 10993

( * ) Notice: Subject to any disclaimer, the term of this patent is extended or adjusted under 35 U.S.C. 154(b) by 0 days.

(21) Appl. No.: 10/387,055

(22) Filed: Mar. 12, 2003

(51) Int. Cl.[7] ..... C25D 17/00; C25B 15/00; C25B 9/00

(52) U.S. Cl. ..... 204/224 M; 204/241; 204/271

(58) Field of Search ..... 204/224 M, 271, 204/241

(56) References Cited

U.S. PATENT DOCUMENTS 4,242,568 A * 12/1980 Wunderlin et al. ..... 219/296
4,966,673 A * 10/1990 Accattato ..... 204/224 M
5,367,607 A * 11/1994 Hufnagl et al. ..... 392/465

* cited by examiner

*Primary Examiner*—Donald R Valentine
(74) *Attorney, Agent, or Firm*—Myron Greenspan; Lackenbach Siegel LLP

(57) ABSTRACT

A device for cleaning jewelry and the like has a housing with an electro-cleaning part and a steam cleaning part. A cleaning bath tank is made of an electrically conductive material. The tank is supported in the electro-cleaning part and can be connected to an electric potential and filled with a conductive fluid that cleans more effectively when heated. The jewelry cleaning device also has an electrical conductor extending into the tank, one that is electrically insulated from the tank and can be connected to an electric potential. There can be placed into the tank an insert with a support surface and conductive engagement means supported so that jewelry engages in an electrically conductive way with the insert. The insert is placed to avoid direct electrical contact between the engagement means and the tank. The device's housing has a water reservoir, a steam nozzle at the steam cleaning part and a single heating element both for the conductive fluid used in the tank and for the water from the reservoir that is converted to steam then released through the nozzle. The electrical current flows through the jewelry, the engagement means, tank fluid and through the tank itself—when the engagement means is electrically connected to the conductor and tank. The conductive fluid permits electrolytic action between the tank and the jewelry. Placing the jewelry in the steam spray from the nozzle removes any remaining contaminants.

17 Claims, 7 Drawing Sheets

DEVICE FOR CLEANING JEWELRY

BACKGROUND OF THE INVENTION

1. Field of the Invention

The present invention generally relates to a device for cleaning and polishing jewelry and the like, and, more particularly, to an improved and comprehensive cleaning device that can clean jewelry or the like initially by electro-cleaning and subsequently by means of steam.

2. Description of the Prior Art

In the past, jewelry, precious gems and metals have been cleaned by various processes. These processes include electro-polishing, ultrasonic cleaning, chemical action cleaning and other processes.

U.S. Pat. No. 4,663,005 issued May 5, 1987, to Edson teaches an electrolytic process employing a non-toxic electrolytic solution. This reference teaches some of the basic concepts of electro-polishing and is specifically directed to a solution to be used in the basic electro-polishing process. Such a process necessarily has its drawbacks relating to the removal of amounts of the metal being polished. This results in the obvious drawback of loss of some of the precious metal forming the piece of jewelry Additionally, problems have been experienced with regard to production of the metal adjacent gemstones or the like forming a part of the jewelry. This often causes the gems to be loose in their fittings and sometimes results in the stones being detached from a metal support. Additional significant problems arise in using an electro-polishing process in small scale operations such as cleaning jewelry (as opposed to cleaning steel or the like, on an industrial level). Electro-stripping (the jewelry acts as an anode at positive potential) causes problems due to the large amount of current drawn during the process. The process can often be dangerous to a user especially when dealing in small scales with arrangements including burners, conductive beakers and power supplies with lead lines going to the jewelry and the conductive beaker.

Ultrasonic cleaning has been used in the jewelry fields due to its ease of use in small scale operation such as the cleaning of jewelry (as opposed to the cleaning of steel or the like in industrial settings). Such ultrasonic arrangements may be sized for the cleaning of individual jewelry items and may be easily used with little danger to a jeweler or operator of the equipment. Unfortunately, ultrasonic cleaning tends to damage jewelry and particularly damages jewelry with gemstone settings and the like. Ultrasonic cleaning tends to vibrate the stones to either cause the stones to be disengaged from the jewelry setting or to become chipped or cracked as a result of the ultrasonic cleaning. Accordingly, ultrasonic cleaning provides a convenient arrangement but, the damage to jewelry is unacceptable, especially the damage to the jewelry after repeated ultrasonic cleanings.

Thermal and chemical actions have been employed to clean metal and stones for some time. Unfortunately, some chemicals and thermal action on a small scale tends to be dangerous due to the high heat levels and the caustic nature of the chemicals. Additionally, some chemical and thermal action tends to erode the metals and can significantly damage jewelry over time. As with other processes, chemical action tends to loosen gemstones mounted in metal settings of the jewelry. Such thermal chemical processes may include alkaloid or acid substances which act on the metal or gem surface to result in cleaning action.

The known processes suffer from several different problems. The electro-stripping processes tend to be awkward and extremely dangerous when used to clean jewelry and the like. Accordingly, electro-stripping is more often used in industrial metallurgical processes. Ultrasonic cleaners readily adapt to use by jewelers due to the known compact arrangements which are safe and easy to use. Unfortunately, ultrasonic cleaners tend to damage jewelry to a great extent and do not provide the desirable cleaning effect which the electro-stripping processes provide.

In U.S. Pat. No. 4,966,673, a device for cleaning and polishing jewelry is described that provides for cleaning of jewelry items or the like in a two-step process—first electro-cleaning in a bath tank, and, subsequently, exposing the item to be cleaned to a jet of steam to remove any remaining or entrapped contaminants. However, this patented device had a number of drawbacks. Steam is generated by heating a water tank, essentially utilizing a small boiler. This requires a container that could withstand high pressures. Such containers are both dangerous and costly, particularly since additional valves are also needed in order to prevent excessive pressures from building up within the container and for selectively releasing steam from the water tank. Additionally, the electro-cleaning tank of the '673 patent is described as containing conductive fluid that is heated to enhance the activity of the electro-cleaning action. In the aforementioned patent, separate heating elements are provided for both the electro-cleaning tank as well as for the water container or reservoir used to generate the steam. The use of separate heaters, again, increases the cost and overall reliability of the unit. Thus, while the additional costs might be acceptable for use by the jewelry trade or the like, the additional costs and dangers inherent in the use of the previous device rendered it unacceptable for wider marketing to the general public and average consumers.

SUMMARY OF THE INVENTION

Accordingly, it is an object of the invention to provide a device for cleaning jewelry and the like adapted to be used by jewelers to clean jewelry in a non-industrial or "at home" setting.

It is another object of the invention to provide a cleaning device as in the previous object that is simple to operate.

It is still another object of the invention to provide a cleaning device as in the previous objects that is safe to operate.

It is yet another object of the invention to provide a cleaning device of the type under discussion that is effective in cleaning jewelry without damaging it, without erosion on metallic surfaces of the jewelry or the like.

In order to achieve the above objects, as well as others which will become evident hereafter, a cleaning device for jewelry and the like in accordance with the present invention includes a housing having an electro-cleaning portion and steam cleaning portion. A cleaning bath tank is provided that is formed of an electrically conductive material, said tank being supported within said electro-cleaning portion of said housing and being connectable to an electric potential and being fillable with a conductive fluid that exhibits enhanced cleaning properties when heated. An electrical conductor extends into the interior region of said tank, and is electrically insulated from said tank, and connectable to an electric potential. An insert, in the form of a basket, is movable in relation to said tank and positionable therein. Said insert includes a support surface that supports at least one conductive engagement means for providing electrical conductive engagement with the jewelry or other item to be cleaned. Said insert is arranged to avoid direct electrical contact between said conductive engagement means and said tank. A water reservoir is provided within said housing, and a steam nozzle is provided at said steam cleaning portion. A single heating element heats both the conductive fluid introduced into said tank, and the water drawn from said water reservoir for converting the water into steam, within the heating element, for release through said steam nozzle. In this manner, electrical current can flow through the jewelry being cleaned and said conductive engagement means and said conductive fluid in said tank and said tank, when said conductive engagement means is electrically connected to said conductor and said tank when filled with a conductive fluid to allow electrolytic action between said tank and the jewelry to be cleaned and, subsequently, to allow remaining contaminants to be removed by means of steam by moving the jewelry from said tank into proximity with said steam nozzle from said steam nozzle.

In another variation of the invention, the cleaning action in said cleaning bath tank is effective when the conductive fluid is at ambient temperature (i.e., without being heated). With such a conductive fluid, the heating element need not heat the cleaning bath tank and can be used to only convert water from the water reservoir into steam. Advantageously, feeding means are provided for selectively feeding water from said water reservoir into said steam generating means for generating steam on demand so that only water that is pumped from the water reservoir into the steam generating means is converted into steam upon actuation of said feeding means to feed a predetermined amount of water from said water tank to said steam generating means.

BRIEF DESCRIPTION OF THE DRAWINGS

With the above and additional objects and advantages in view, as will hereinafter appear, this invention comprises the devices, combinations and arrangements of parts hereinafter described by way of example and illustrated in the accompanying drawings of preferred embodiments in which.

DESCRIPTION OF THE PREFERRED EMBODIMENTS

Figure 1:
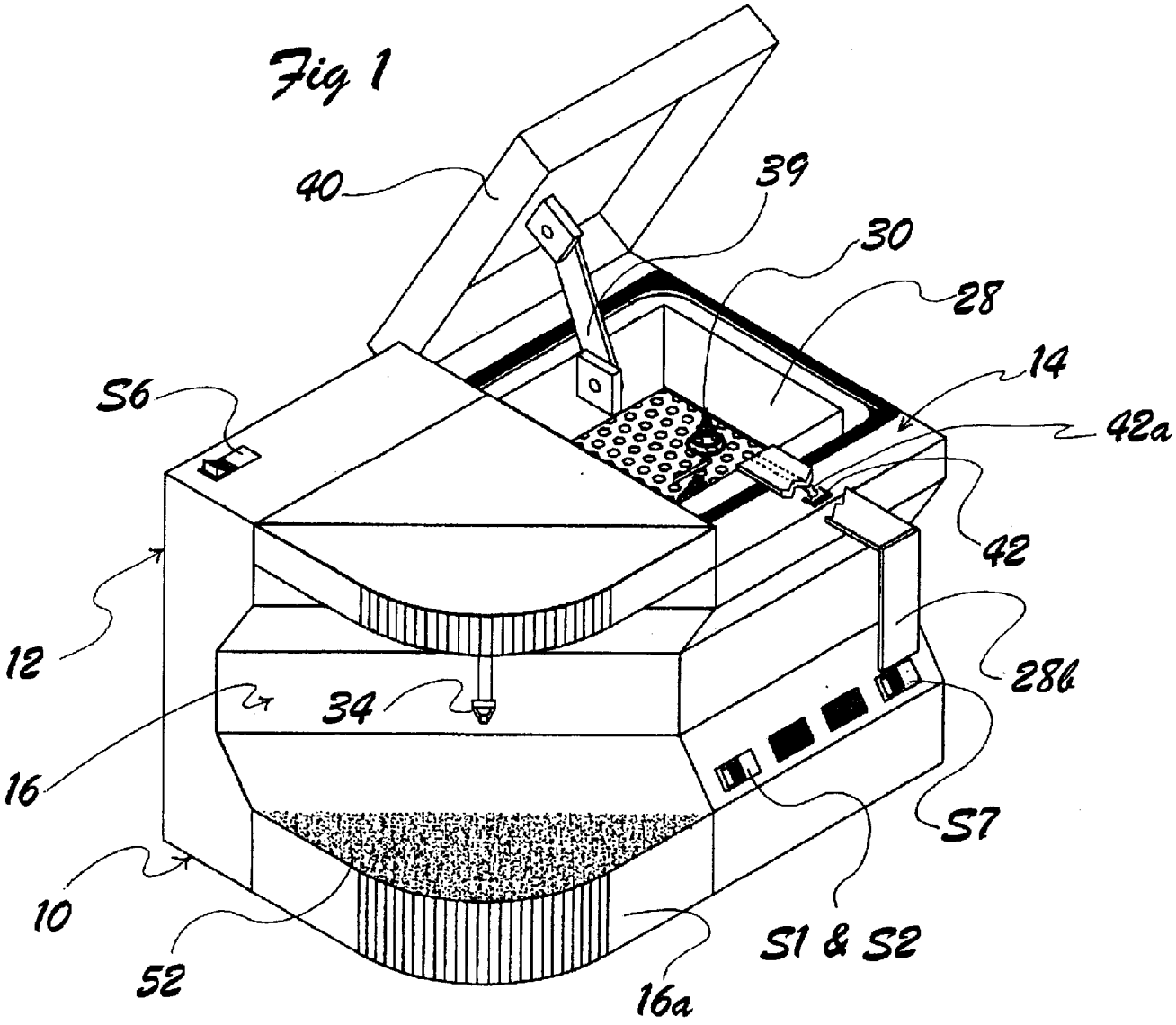
FIG. 1 is a perspective view of a cleaning device in accordance with the present invention, showing the cover or lid of the electro-cleaning portion of the device partially open.
Figure 2:
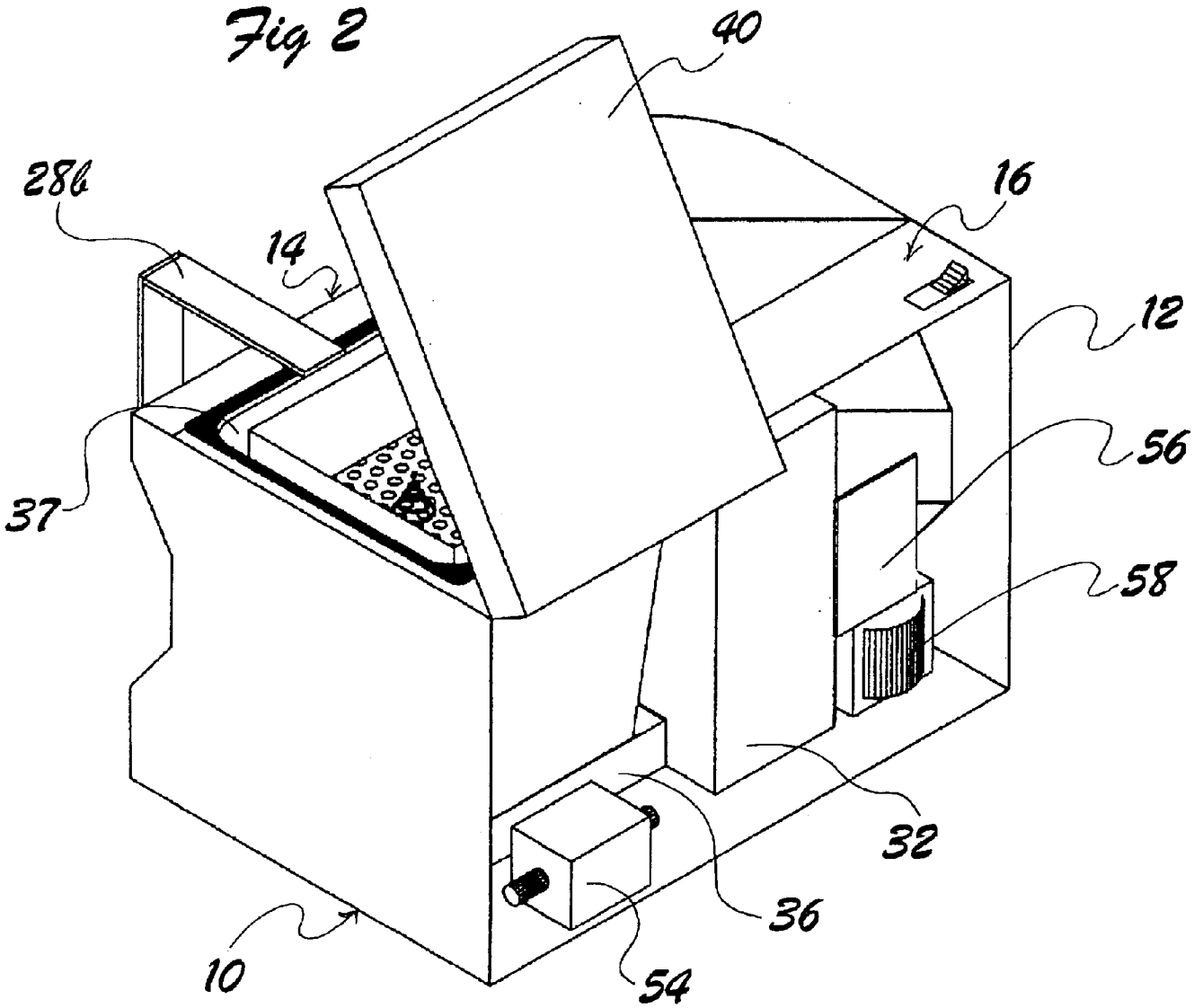
FIG. 2 is a rear perspective view of the cleaning device shown in FIG. 1.
Figure 3:
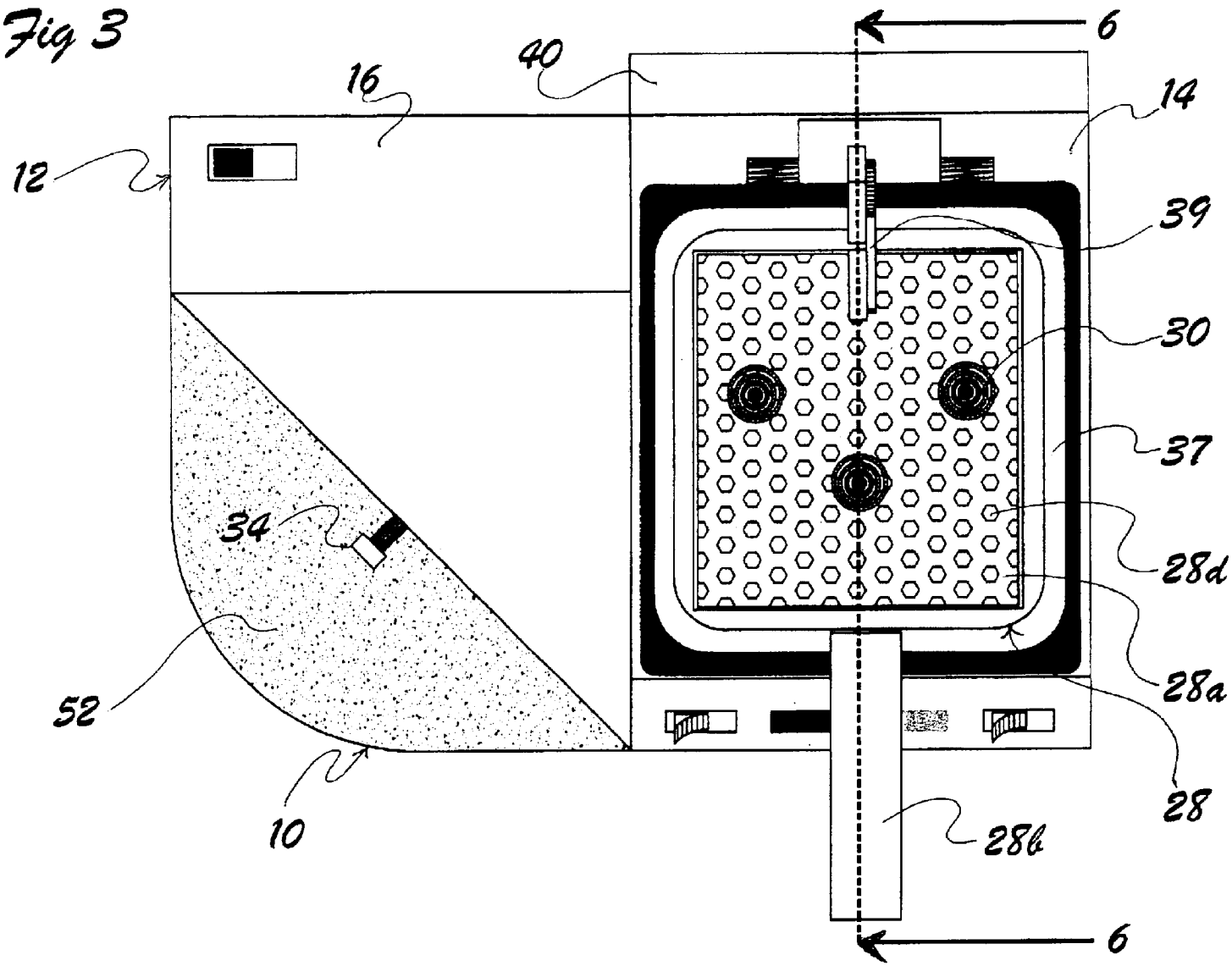
FIG. 3 is a top plan view of the cleaning device shown in FIGS. 1 and 2, with the cover or lid removed to expose the interior of the electro-cleaning portion of the device.

Referring now specifically to the Figures, in which identical or similar parts are designated by the same reference numerals throughout, and referring first to FIGS. 1–3, a cleaning device for cleaning jewelry and the like is generally designated by the reference numeral 10.

Figure 6:
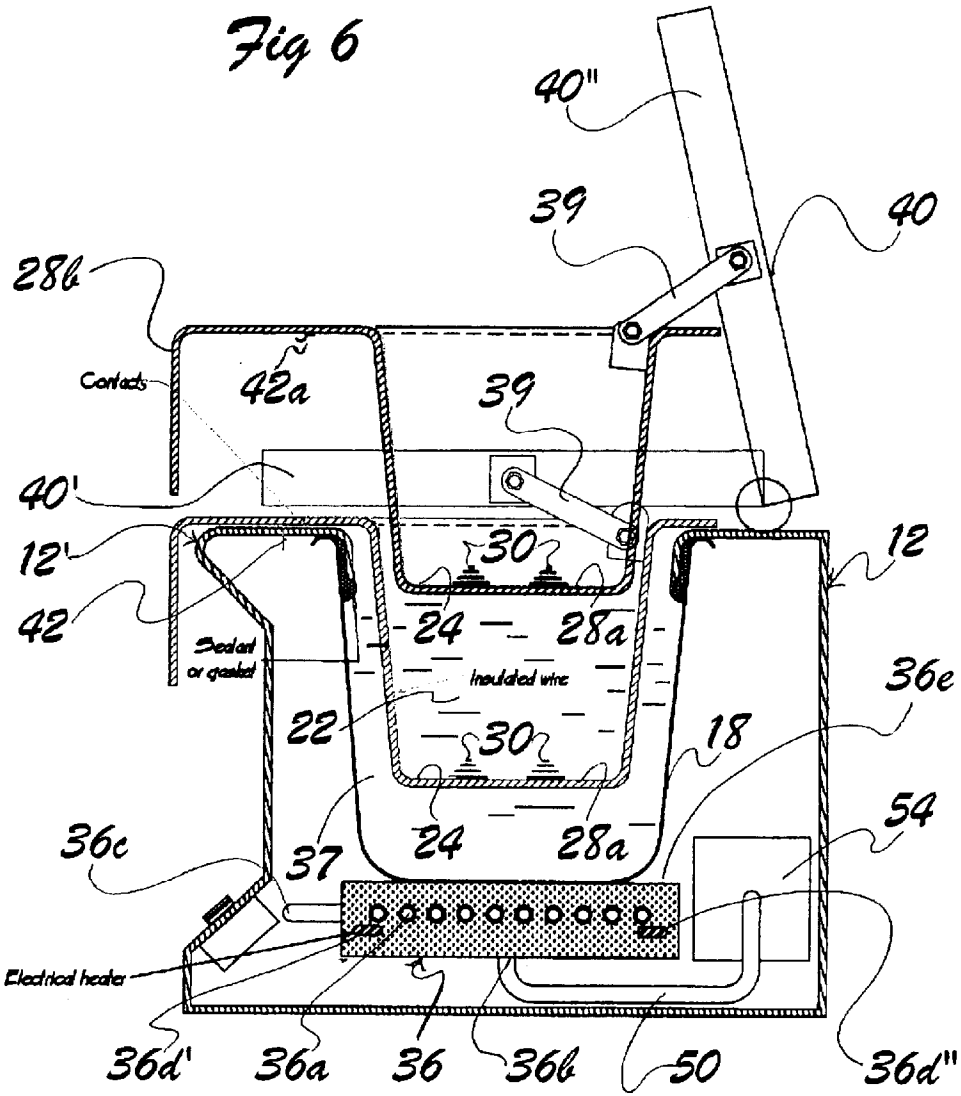
FIG. 6 is a cross-sectional view of a modified design of the cleaning device, generally taken along a plane 6—6 taken in FIG. 3.

The device 10 has a housing 12 that includes an electro-cleaning portion 14 and a steam cleaning portion 16. The electro-cleaning portion 14 includes a cleaning bath tank 18 (FIG. 6) formed of an electrically conductive material, in the presently preferred embodiment, stainless steel. The tank 18 is supported within the electro-cleaning portion 14 of the housing and is connectable to a positive electrical potential 20 (FIG. 8), and is fillable with an electrically conductive cleaning fluid 22 (FIG. 6). In the embodiments shown, the conductive fluid exhibits enhanced cleaning properties when heated. However, as will be discussed, a variation of the invention can be used with a conductive fluid that provides satisfactory cleaning when maintained at ambient temperature, in which case the conductive fluid need not be heated during use.

At least one basket or insert 28 is positionable within the tank 18 that includes a support surface 28*a* and a handle 28*b*. Mounted on the support surface 28*a* is at least one conductive engagement member 30 for engaging and providing electrically conductive contact with jewelry to be cleaned (FIGS. 1, 4, 5, and 6). The conductive engagement members 30 can be in the form of springs or helical coils, as shown, and are more fully described in U.S. Pat. No. 4,966,673, which is fully incorporated herein. It will be clear, however, that any other conductive engagement members may be used, including spring-loaded clips, simple flat or especially configured surfaces on which items of jewelry can be placed, etc. It will be evident, therefore, that by connection of an electrical conductor 24 to the conductive jewelry holders or engagement members 30, the application of a negative potential to the electrical conductor 24 also applies that negative potential to the holders or members 30.

The electrical conductor 24 (FIG. 6) is electrically insulated and/or physically separated from the tank 18 and preferably extends into the interior region of the insert 28. The electrical conductor 24 is adapted to be connected or connectable to engagement members 30 at one end, and at the other end with a contact 42*a* on handle 28*b* of insert 28. Contact 42*a* is connectable to a negative electrical potential 26 via a contact 42 on shoulder 12' of housing 12, as described in more detail hereinbelow.

A water reservoir 32 is provided within the housing. However, unlike the reservoir disclosed in U.S. Pat. No. 4,966,673, the water reservoir 32 in accordance with the present invention can be any container for holding the water, including containers made of a plastic material, an open container or the like, since steam is not generated within the water container 32 and there is no pressure buildup therein. The water in the water reservoir 32 is directed to a steam generation station, to be described, where selected quantities of water are converted into steam. Steam so generated is released as a jet of steam through a steam nozzle 34 at the steam cleaning portion 16.

In the case of embodiments that are intended to be used with a conductive fluid that exhibits enhanced cleaning properties when heated, a single heating element 36, in accordance with the present invention, serves the dual functions of heating the conductive fluid introduced into the tank 18 and for heating water from the reservoir 32 to convert the water into steam for release through the steam nozzle 34.

Since the conductive tank 18 is connected to an electrical potential 20 (FIG. 8), the manner in which the insert 28 is placed within the tank 18 and its dimensions and its ability to make physical contact with the metallic portions of the tank will depend on the material from which the insert 28 is made. If the insert 28 is made of a non-conductive material, such as plastic or an insulated mesh or wire basket, it should be clear that the insert can have any dimensions that will fit within the tank 18 even if the walls or the bottom of the insert make contact with the exposed or conductive portions of the tank. However, if the insert 28 is made of a conductive material, the bottom wall or side wall of the insert cannot make contact with the tank 18 when in the fully inserted position shown, for example, in FIGS. 1 and 2. In that event, the basket must be made smaller so that there is a space or clearance 37 between the insert and the stainless steel tank.

In order to effect electro-cleaning of an item of jewelry, for example, placed on a conductive jewelry holder or engagement member 30, a direct current must be capable of flowing through the following: from the source of positive potential at 20 (FIG. 8) through the tank 18, the conductive fluid 22, the conductive engagement member 30, the item of jewelry supported thereby, and the electrical conductor 24, to return to the negative potential 26.

A lid or cover 40 may be provided with a safety-disengaging arm 39 for moving the insert 28 from a lowered position within the tank 18, whereby the conductive engagement members 30 are electrically engaged with the negative potential 26 via electrical conductor 24 and contacts 42, 42*a*, to an elevated position, whereby the conductive engagement members 30 are electrically disengaged from the negative potential 26. In the elevated position, the bottom of insert 28 preferably lies above the surface level of the conductive fluid 22 in the tank.

As best shown in FIG. 6, the safety disengagement arm 39 is hingedly connected to lid 40, and lid 40 is hingedly connected to the housing 12. The lid or cover 40 is movably mounted between a first forward or closed position 40', and a second, elevated or open position 40". As discussed in U.S. Pat. No. 4,966,673, and as will be evident from FIG. 6, the closing of the cover 40 lowers the insert 28 to a position in which an annular or circumferential flange 28*a* of the insert 28 rests upon and makes contact with a shoulder 12' of the housing. Opening of the lid 40 can substantially elevate the insert 28. Advantageously, a contact 42 is mounted on shoulder 12' and disposed opposite to a contact 42*a* that is mounted on the insert 28, whereby contacts 42, 42*a* are physically in contact when lid 40 is lowered or closed, but are physically separated when lid 40 is raised or elevated. Contact 42 is connected to the negative electrical potential 26, while contact 42 is connected via the conductor 24 to the engagement members 30. The contacts 42, 42*a* are open to prevent current flow through the conductive fluid 22 when the insert 28 is at least partially raised or withdrawn from the tank 18. The contacts 42, 42*a* and closed to enable current flow through the conductive fluid 22 when the insert 28 is fully received within the tank 18. The contacts 42, 42*a* therefore, effectively serve as a safety control when the cover 40 is opened that overrides any other switch or control that might cause a current to flow through the tank.

It should be clear that numerous other safety mechanisms can be used in lieu of the safety-disengagement member 39, shown in the form of a link pivotally hinged to both insert 28 and the cover 40. Thus, for example, any manual or electro-mechanical device or mechanism responsive to the closing of the cover or lid 40 that can actuate a microswitch or the like can be used equally effectively.

Figure 7:
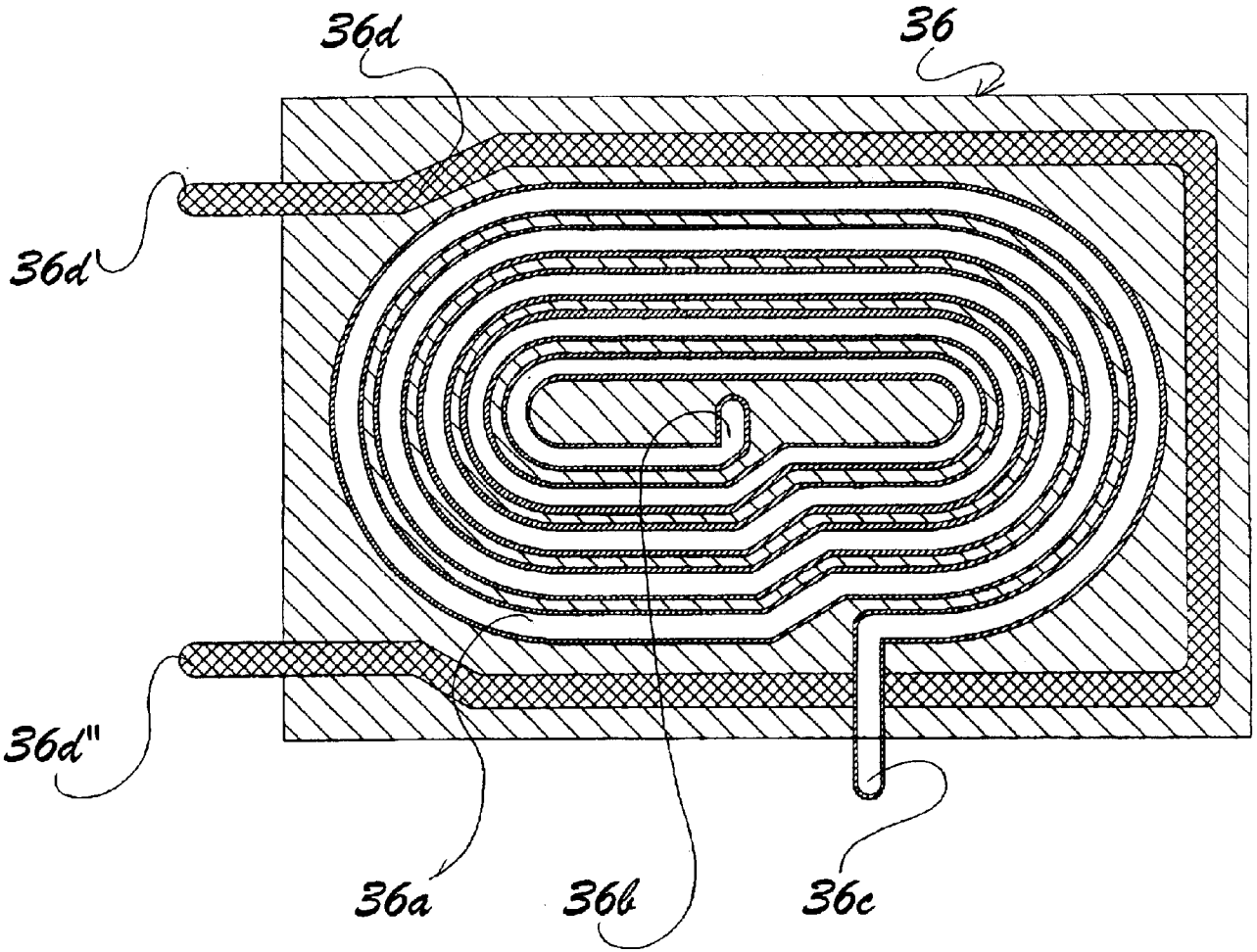
FIG. 7 is a cross-sectional view of a steam-generating member or thermoblock shown in FIG. 6.

The heating element, in accordance with the present invention, is in the form of a thermoblock heater. Such thermoblock may be in the form of a cast aluminum block 36 (FIGS. 6 and 7) provided with a conduit 36*a* having a water inlet end 36*b* and a steam outlet end 36*c*. As is best shown in FIG. 7, the conduit is in the form of a spiral to increase the length of the conduit and to maintain the water introduced at the inlet end 36*b* in the block 36 for a longer period of time in order to optimize heat transfer and conversion of the water into steam at the outlet end 36*c*.

Extending about to the periphery of the cast aluminum block 36 is a heating element 36*d* that generally forms a U-shape and has its ends 36*d'* and 36*d"* projecting exteriorly of the block 36. The heating element 36*d* is in the form of a resistive conductor that generates heat when a current is passes through it, this heat being transferred to the block 36 to thereby elevate the temperature of the block 36 and thereby effect heat transfer to liquid flowing through the conduit 36*a*. Advantageously, the conduit 36*a* in the block 36 is in the form of a stainless steel line arranged in a coil configuration, as shown, to enhance or optimize heat transfer from the block to the water introduced into the line. The stainless steel protects the block 36 and increases the life and reliability thereof.

Advantageously, when the cleaning device 10 is used with a conductive fluid 22 that exhibits enhanced cleaning properties when heated, the block 36 is provided with a generally flat upper surface 36*e* that is suitable for making contact with the tank 18. The surface 36*e* can also be made in any other shape that conforms to the shape of the stainless steel tank at the point of contact. Therefore, if the bottom wall of the tank 18 exhibits a convex surface, the surface 36*e* can be formed in a complementary concave surface that provides optimum surface contact area for optimizing heat transfer from the block 36 to the tank 18.

If, on the other hand, the cleaning device is to be used with a conductive fluid that need not be heated to improve or optimize the cleaning or operating properties of the fluid, the block 36 may be spaced from the tank 18 and assume any shape or configuration, since, in that event, no heat transfer needs to take place between the thermoblock 36 and the tank 18.

Figure 5:
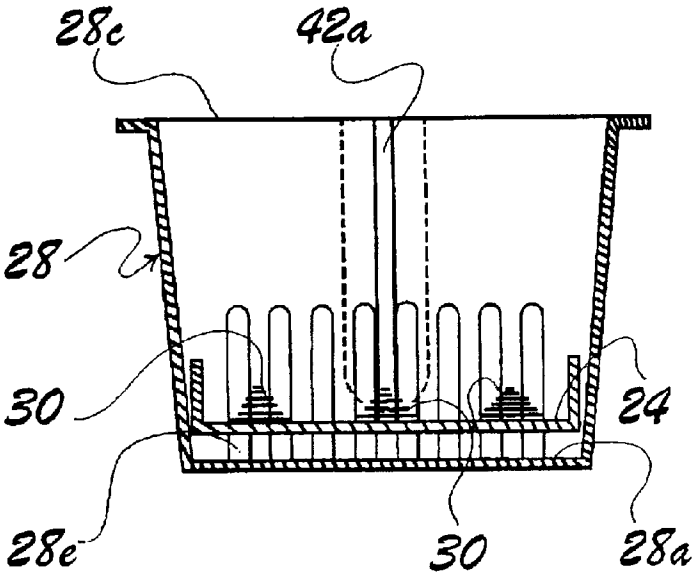
FIG. 5 is a cross-sectional view of the insert shown in FIG. 4, generally taken along a plane 5—5 taken in FIG. 4.
Figure 4:
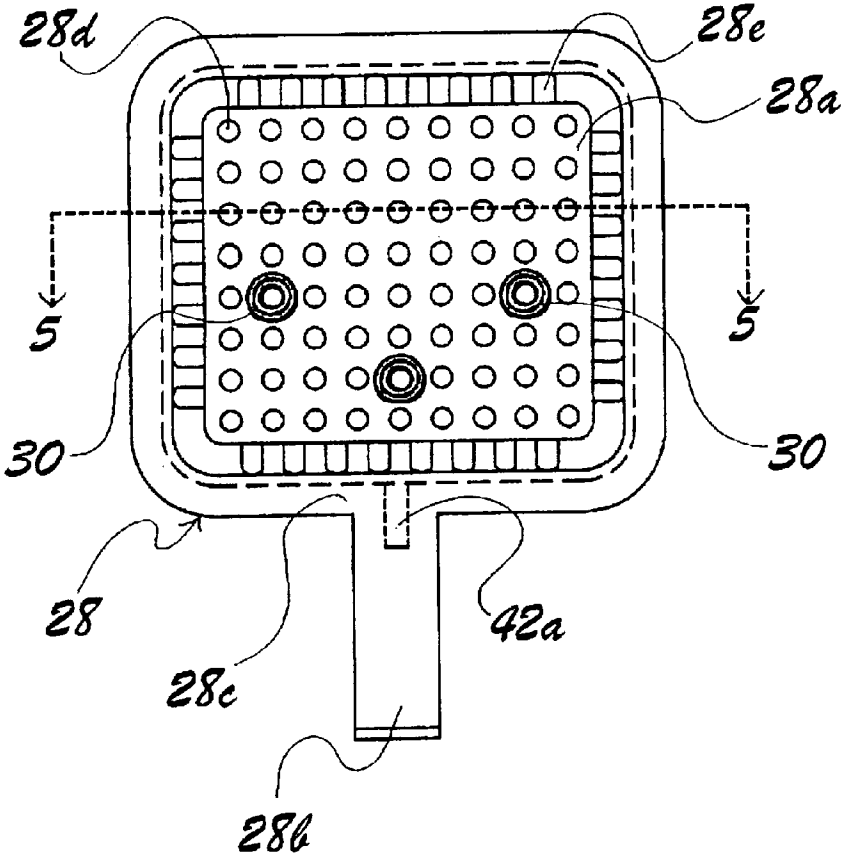
FIG. 4 is a top plan view of the insert or basket that is movably inserted into the cleaning bath tank of the electro-cleaning portion of the device shown in FIGS. 1–3.

As best shown in FIGS. 4 and 5, the insert 28 is formed with a plurality of holes 28*d* in the bottom wall thereof, and also optionally with openings or apertures 28*e* in the side walls thereof to allow conductive fluid 22 to pass from the tank 18 into the insert 28, filling same, when the insert 28 is lowered into the tank 18, and for flowing back from and draining the insert 28 when it is raised from the tank 18. During use, conductive fluid 22 must be present in the insert 28. However, such fluid is preferably removed when the insert is raised, as shown in FIG. 6, to facilitate the placement of items of jewelry on the conductive engagement members 30, to facilitate removal of the jewelry from the insert, and to enhance safety by preventing potentially dangerous contact with conducting fluid 22, especially when conducting fluid 22 is heated by block 36. An important feature of the invention is the use of a pump 54 that provides a feeding mechanism for feeding water from the water reservoir 32 to the block 36 by means of a water inlet tube 50 that connects the pump 54 with the water inlet 36*b* of the conduit 36*a*. By providing suitable electrical controls, to be discussed below, the water pump 54 can selectively transfer water from the water reservoir 32 to the conduit 36*a* and to the thermoblock heater 36 when steam is to be formed. In this way, only water pumped into the thermoblock 36 is converted into steam, the water remaining in the water reservoir not being heated or placed under pressure.

Thus, the pump 54 serves as a water feeding mechanism for selectively feeding water from the water reservoir 32 into the steam generating conduit 36*a* for generating steam on demand, without the need to use a valve.

The steam cleaning portion 16 is preferably provided with a catch-basin 16*a,* including a sponge 52 to absorb condensation resulting from steam released from the steam nozzle 34.

Figure 8:
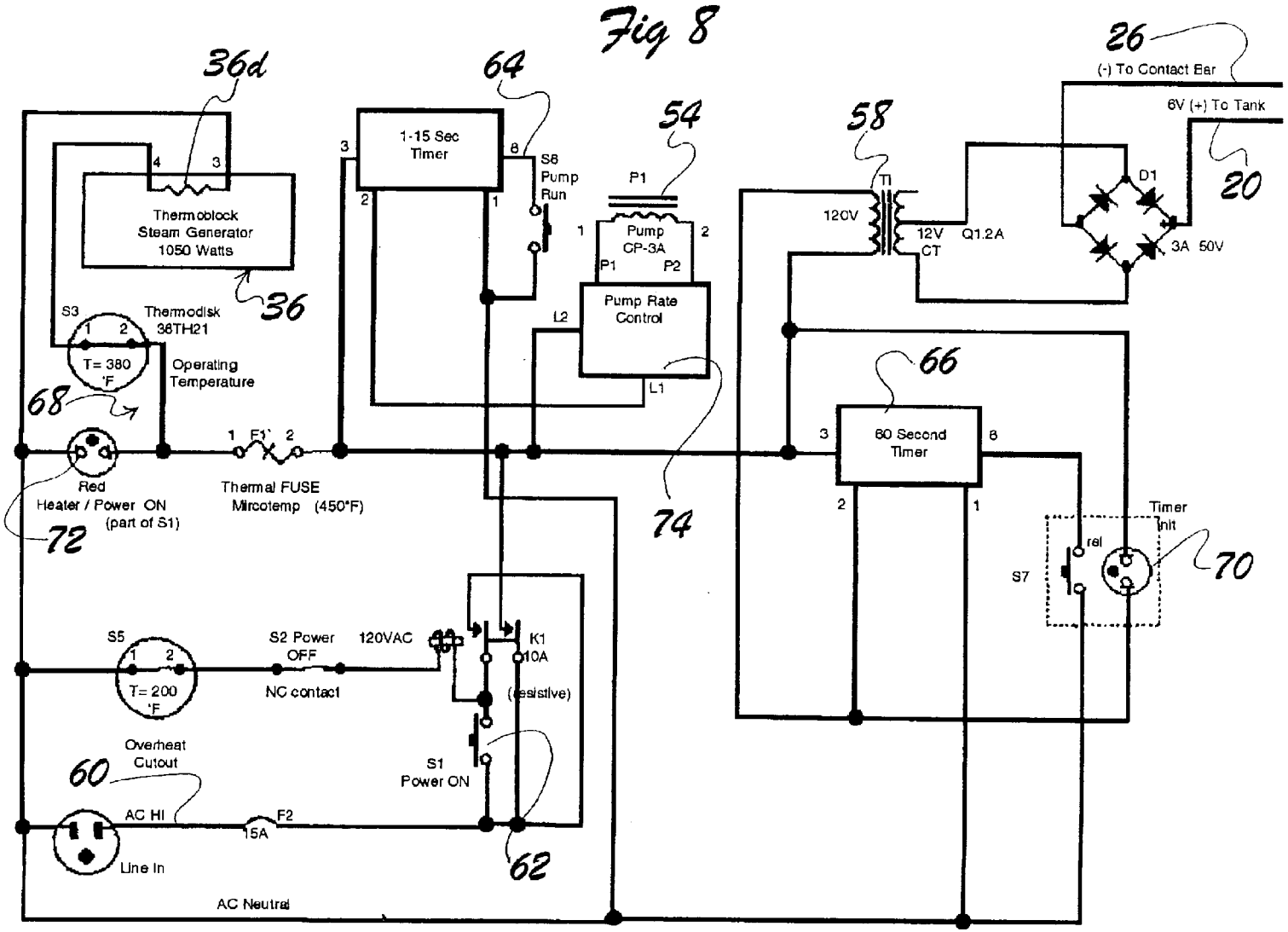
FIG. 8 is a schematic view of the electrical circuit that can be used in conjunction with the cleaning device of the present invention.

Referring to FIG. 8, an electrical circuit is shown that can be used in connection with the cleaning device 10. Some of the components can be mounted on a printed circuit board 56 (FIG. 2). The transformer 58, forming part of the power supply 60 of the unit, is shown mounted below the printed circuit board 56 in FIG. 2. In addition to the power supply 60, the circuit includes the following primary circuits:

power control circuit 62;

water feeding circuit 64;

cleaning cycle or timer circuit 66; and steam generation or heater circuit 68.

The power control circuit 62 includes a normally open "power-on" switch S1. When temporarily depressed, the switch S1 applies the line-in voltage across the coil of solenoid K1 having two normal open contacts. When the solenoid K1 is energized, the two associated contacts close, one of them being used to latch the relay in an energized condition even after the release of the switch S1. A normally closed "power-off" switch S2 is placed in series with the relay, the actuation of the switch S2 opens the circuit for the relay coil and unlatches the relay contacts. An overheat cut-out switch S5 may be provided in series with the switch S2 to effectively also open the circuit for the relay K1 when the switch exceeds a predetermined temperature, such as 200° F.

A fuse F2 is also shown in series with the line, again for the purpose of unlatching the relay K1 if the current in the input line exceeds a predetermined amount of current, such as 15 Amps.

The power supply circuit 60 includes a timer circuit 66, which is actuated when a normally open switch S7 is depressed. The timer circuit 66 sets the time for the cleaning cycle, which corresponds to the time that an electrical potential is applied across the tank 18 and the electrical conductor 24 to provide current flow through the conductive fluid 22 in the insert 28. The timer TR1 may be any commercially available timer, whether electromechanical or based on an integrated circuit, such as timer IC 555, manufactured by numerous semiconductor integrated circuit manufacturers.

It will be clear that when the timer circuit 66 is actuated for a predetermined term of time, such as 60 seconds, full line voltage is applied across the primary coil of the transformer 58, the secondary coils of the transformer 58 being applied across a full wave rectifier D1 having a positive DC voltage at line 20, which is applied to the tank 18. The negative output of the rectifier D1, at 26, is applied to the electrical contact 42, which is selectively connected to the conductor engagement members 30. The full bridge rectifier D1 preferably generates a low voltage output, such as 6 volts DC, with an output of up to 2–3 Amps. Advantageously, a visible indicator, in the form of a lamp such as an LED lamp 70 is provided across the timer circuit 66 so that the LED 70 is energized during the timing cycle to provide a visual indication that the timing cycle is in progress. When the LED 70 is energized, therefore, this signifies that a potential is applied to lines 20, 26.

The heater circuit 68 includes the heating element 36*d* which is placed across the line voltage when the relay K1 is energized and latched. The line voltage is also applied across an indicator lamp 72, which is essentially in parallel with the heating element 36*d*. The indicator 72, therefore, is energized and visible whenever power is applied across the heating element 36*d* indicating that the block 36 is being heated as a result of current flow through the heating element 36*d*. A thermal fuse F1 may be placed in series with the line voltage circuit applied to the heater circuit 68, the fuse being placed in contact with the thermal block 36 to monitor the temperature of the block 36 and remove the line voltage from the heating element 36*d* when the temperature of the heater block 36 exceeds a predetermined temperature, such as 450° F.

A second temperature-sensitive element S3 is shown in series with the thermal fuse F1 to provide redundant protection against overheating of the thermal block 36. The temperature-sensing element S3 is in the form of a thermodisc that removes the line voltage from the heating element 36*d* when the temperature reaches 380° F. Naturally, the sensing element S3 will normally open before the thermal fuse F1 opens because of the differential in the sensing temperatures of these units. Unless the thermoblock 36 overheats, therefore, it will remain heated after the "power-on" switch S1 has been pressed until the "power-off" switch S2 is pressed, or one of the temperature-sensing elements overheats.

The water feeding circuit 64 includes a timer TR2, which can, like timer circuit 66, be an electromechanical timer or an integrated circuit timer, such as the IC 555. A normally open switch S6 is connected across the timer TR2. When the pump run switch S6 is momentarily closed, the timer TR2 sets a steam cycle which can be any predetermined period of time, such 1–15 seconds or more. The timer shown is a fixed cycle timer and cannot be adjusted once the initial adjustment is made. However, if desired, timers 66 and TR2 can be selected to provide the user with an adjustment on the length of time that the respective cleaning and steam cycles last. When the pump run switch S6 is energized, a voltage is applied across the pump rate control circuit 74, which, in turn, actuates the pump 54. It will be clear, therefore, that actuation of the pump run switch S2 causes the pump 54 to pump water for a predetermined time from the water reservoir 32 to the heating element or thermoblock 36.

As indicated, since the thermoblock 36 remains at a relatively elevated temperature at all times during the use of the cleaning device, the water pumped into the thermoblock unit 36 will rapidly be heated and vaporized to generate the steam. If desired, a separate valve can be placed in the steam line 36*a* to release or block the issuance of the steam from the steam nozzle 34, or the steam may simply emanate from such nozzle whenever the pump run switch S6 is depressed for the given steam cycle. Once all the water has been pumped during the steam cycle into the thermoblock 36, no further water is received within the thermoblock unit 36, and generation of steam ceases.

The electrically conductive tank 18 is filled with a mixture of water and a powder (such as a commercial available product sold by Oaklite Products, Berkeley Heights, N.J., under the trade name OAKITE 90) that disassociates into ions in the water. The powder preferably includes a blend of anionic and non-ionic surfactants and alkalis including caustic soda, silicates and phosphates. A portion of the powder mixed with water provides the electrically conductive fluid 22, which is formulated or designed to anodically remove smut, oil, and the like. The electrically conductive fluid 22 generates bubbling adjacent to the negatively charged jewelry, which removes carbon pigments and the like from the surface of the jewelry without removing the metal or damaging the gemstones.

The steam is sprayed on jewelry as the second step in the cleaning process after electro-cleaning. A catch basin containing the sponge 52 catches the steam to reduce the spray and captures the steam.

The jewelry to be cleaned is positioned in the stainless steel tank 18 in a plastic jewelry holder 28 having the plurality of holes 28*d* and 28*e* therein to drain off the electrically conductive cleaning fluid 22. This fluid 22 may comprise a mixture of water and a conductive fluid which is sold commercially as an electrocleaner such as OAKITE 90, a powdered alkaline material designed to remove smut, oil, and the like.

The rim of the stainless steel tank 18 may be sheathed with polypropylene or ABS plastic to prevent jewelry from making contact with the tank 18. When the lid 40 is closed, moisture that has built up on the lid 40 runs back into the stainless steel tank 18. The insert or basket 28 includes plastic gripping handle 28*b* that engages the sidewall 12' to hold the basket in the tank 18 and to facilitate removal of the basket 28 with the jewelry after cleaning. A gold plated contact 42*a* is mounted on the basket 28 to engage the tank 18. After the insert 28 is lowered into the tank 18, the contact 42*a* engages the contact 42 that is mounted on shoulder 12' complementary to contact 42*a* on handle 28*b*. Engaging contacts 42, 42*a* enables an electrical current to be passed through conductor 24 to engagement members 30.

As shown in FIG. 8, a small solenoid pump 54 is used to deliver distilled water, preferably as small droplets, through the channel 36*a* of thermoblock 36 to create steam to clean rinse the jewelry.

General directions for utilizing the cleaning device 10 include placement of the device on a flat, firm surface, such as a counter top in a kitchen. With the power switch OFF, the plug for the unit is inserted into a 120-volt electrical outlet. The insert 28 is then raised by opening of the cover or lid 40. The tank 18 is then filled with distilled or tap water just until the level of the water is a approximately one inch from the top of the tank 18. Cleaning powder comprising an electrically conductive material is sprinkled into the water, and the water is stirred to dissolve the cleaning powder, thereby making electrically conductive fluid 22. The "power-on" switch S1 is now moved to the ON position or pressed, and the red indicating light 72 will come on, as indicated. Current now flows through the thermoblock heating element 36*d* and the thermoblock 36 becomes heated. Since the thermoblock 36 is in heat transfer relationship with the stainless steel tank 18, the tank and the conductive fluid 22 within the tank 18 become heated. It may take 10–15 minutes for the conductive fluid to heat up.

Items of jewelry can now be attached to the conductive engagement members 30 disposed within the insert 28. If desired, the electrical conductor 24 may also be connected, in addition to all of the conductive engagement members 30, to a generally flat conductive plate 28*a,* on which small items of jewelry such as diamond studs, small chains, rings, and other items can simply be deposited. Similarly, conductive hooks 28*f* may be provided within the insert 28, also connected to the electrical conductor 24, for hanging larger objects such as earrings, necklaces and bracelets. Regardless of the configuration of the conductive engagement members within the insert 28, they are all connected to the electrical conductor 24 so that a potential is applied to the items of jewelry, no matter how they are electrically connected or mechanically supported within the insert. Springs and clips, as well as other fastening or securement elements, therefore, can also be used.

When all the items of jewelry have been connected and attached within insert 28, the tank opening can be closed by the lowering of the lid or cover 40. As suggested in FIG. 6, the closing of the cover or lid will lower the insert 28 into the tank 18 so that all the items of jewelry are fully submersed in the conductive fluid 22. The cleaning switch S7 can then be depressed to start a cleaning cycle. If the items of jewelry are very dirty, this cleaning cycle can be repeated, or the items can be left in the conductive fluid 22 to soak for awhile in the heated bath.

Once the jewelry has been mostly cleaned in the cleaning bath, the insert 28 is raised by the opening of the cover or lid 40 so that the items of jewelry rise above the level of the conductive fluid 22. This facilitates the removal of the jewelry from the insert 28. A tweezers or similar gripping device may be to used to grip and remove each item of jewelry from the insert 28, as these items of jewelry may still be hot from the heated conductor fluid. Preferably, the items of jewelry are then placed in a strainer, on a sponge, or the like (not shown) to allow the items of jewelry begin to dry when they are initially removed from the conductive fluid 22. Each item of jewelry can then be gripped, such as by use of a long tweezers, and placed under the steam nozzle 34. At such time, the pump run switch S6 can be pressed to cause the pump 54 to direct water from the water reservoir 32 for a predetermined time period which defines the steam cycle. Steam will be generated in the thermoblock 36, and ejected through the steam nozzle 34 in order to blow out any remaining contaminants that are stuck within recesses or traps in the jewelry. The jewelry is now clean, and it may be placed on a paper towel and allowed to cool.

As should be clear from the above description, the present invention provides an electrochemical operation by causing current to flow through the jewelry to be cleaned during the cleaning cycle. The cleaning device is them provided with an integrated steam cleaner, which allows steam then to remove any remaining contaminants on the ring.

Unlike ultrasonic or electro-sonic machines that try to vigorously shake the dirt and grime out of jewelry, the cleaning device in accordance with the present invention sends a DC current directly through the metallic jewelry to be cleaned. This creates not only a safe, smooth whirlpool effect but also a powerful eftervescent action directly on the metallic surfaces of the jewelry, dislodging the softened dirt and grime without having to shake or vibrate the cleaning bath itself. At the same time, diamonds or gemstones safely soak in the specially formulated cleaning solution without the adverse effects that vibration or shaking can have on delicate.

The varieties of powder cleaner that can be used to render the water a conductive fluid are discussed in U.S. Pat. No. 4,966,673. The cleaning formula attacks fat and oil deposits on the surface of the items of the jewelry, which surface acts as a breeding ground for bacteria that accumulate, mainly in the back area or in small, hard-to-get-at crevices of the jewelry, leaving it dull and lifeless. Such bacteria can create an itchy rash on fingers, ears, neck or any other locations that are adorned by the jewelry.

As suggested, while heat is always a great help in speeding up the cleaning process and activating the conductive cleaning powder, the present invention can also be used, in some of its forms, without the use of heated conductive fluid, and without heating the same by means of the thermoblock 36 or any other heating element.

The cleaning device of the present invention, in effect, sterilizes the jewelry, using heat, water and steam pressure to accomplish the cleaning function.

While this invention has been described in detail with particular reference to preferred embodiments thereof, it will be understood that variations and modifications will be effected within the spirit and scope of the invention as described herein and as defined in the appended claims. Thus, while the invention 20 is described in the disclosure with respect to electro-cleaning, the teachings may also be used with ultrasonic cleaning in an economy version of the invention.

What is claimed is:

1. A device for cleaning jewelry and the like, comprising:

a housing having an electro-cleaning portion and a steam cleaning portion;

a cleaning bath tank formed of an electrically conductive material, said tank being supported within said electro-cleaning portion of said housing and being connectable to an electric potential and being fillable with a conductive fluid that exhibits enhanced cleaning properties when heated;

an electrical conductor extending into the interior region of said tank, said electrical conductor being electrically insulated from said tank and being connectable to an electric potential;

an inert positionable in said tank and including a support surface;

conductive engagement means, supported by said insert, for electrical conductive engagement with jewelry to be cleaned, said insert being arranged to avoid direct electrical contact between said conductive engagement means and said tank;

a water reservoir within said housing;

a steam nozzle at said steam cleaning portion;

a single heating element for heating the connecting fluid introduced into said tank and for selectively feeding water from said reservoir and converting the water into steam for release through said steam nozzle; and feeding means for selectively feeding water from said water reservoir through said single heating element for generation of steam on demand while continuing to heat said cleaning bath tank for the electrically conductive material, whereby an electrical current can flow through the jewelry being cleaned and said conductive engagement means and said conductive fluid in said tank and said tank when said conductive engagement means is electrically connected to said conductor and said tank, when filled with conductive fluid to allow electrolytic action between said tank and the jewelry to be cleaned and, subsequently, to allow remaining contaminants to be removed by means of steam by moving the jewelry from said tank into proximity with said steam issuing from said steam nozzle.

2. A device for cleaning jewelry and the like according to claim 1, further comprising: safety disengagement means for moving said insert from a position within said tank wherein said conductive engagement means is electrically engaged with said electrical conductor to an elevated position wherein said conductive engagement means is electrically disengaged, said insert lying above a level of the fluid disposed in said tank in said elevated position.

3. A device for cleaning jewelry and the like according to claim 2, wherein said safety disengagement means includes a lid hingedly connected to said housing positioned about said tank, said lid being movable between a first forward position and a second elevated position, and a link mechanism connecting said lid and said insert for raising and lowering said insert into and out of said tank with corresponding movements of said lid.

4. A device for cleaning jewelry and the like according to claim 1, further comprising a thermostat for sensing the temperature of fluid in said tank and for regulating said heating element to maintain the fluid in said tank in a predetermined selected temperature range.

5. A device for cleaning jewelry and the like according to claim 1, wherein said conductive engagement means includes a conductive spring member which is extensible and contractible to grasp and electrically engage jewelry to be cleaned.

6. A device for cleaning jewelry and the like according to claim 1, wherein said tank is formed of stainless steel.

7. A device for cleaning jewelry and the like according to claim 1, wherein said insert support surface is formed with a plurality of holes allowing fluid to pass from below said support surface to above said support and from above said support surface to below said support surface when said insert is moved within said tank.

8. A device for cleaning jewelry and the like according to claim 1, wherein said water reservoir is connected to a steam conduit, and further comprising a valve controlling flow from said steam conduit and said steam nozzle when said valve is in an open position.

9. A device for cleaning jewelry and the like according to claim 1, wherein said tank is at positive potential and said electrical conductor is at negative potential.

10. A device for cleaning jewelry and the like according to claim 1, further comprising control means for controlling the supply of power to said tank and said electrical conductor.

11. A device for cleaning jewelry and the like according to claim 1, wherein said single heating element comprises a thermoblock heater provided with a conduit through which water can pass to be heated and converted to steam and having a heating surface in contact with said tank for heating fluid placed in said tank.

12. A device for cleaning jewelry and the like according to claim 11, further comprising a pump for selectively transferring water from said water reservoir to said conduit in said thermoblock heater when steam is to be formed, whereby only water pumped into said is converted into steam.

13. A device for cleaning jewelry and the like according to claim 11, wherein said thermoblock comprises a cast aluminum block and said conduit comprises a stainless steel line arranged in a coiled configuration to enhance heat transfer from said block to water introduced into said line.

14. A device for cleaning jewelry and the like according to claim 1, wherein said insert is made of a non-conductive material.

15. A device for cleaning jewelry and the like according to claim 1, wherein said support surface of said insert is spaced from the internal surface of said tank.

16. A device for cleaning jewelry and the like according to claim 1, further comprising a pair of contacts, one connected to said electrical conductor and another connected to said tank, said pair of contacts being open to prevent current flow through the conductive fluid when said insert is at least partially ejected from said tank and being closed to enable current flow through the conductive fluid when said insert is received with said tank.

17. A device for cleaning jewelry and the like, comprising:

a housing having an electro-cleaning portion and a steam cleaning portion;

a cleaning bath tank formed of an electrically conductive material, said tank being supported within said electro-cleaning portion of said housing and being connectable to an electric potential and being fillable with a conductive fluid that exhibits enhanced cleaning properties when heated;

an electrical conductor extending into the interior region of said tank, said electrical conductor being electrically insulated from said tank and being connectable to an electric potential;

an insert positionable in said tank and including a support surface;

conductive engagement means, supported by said insert, for electrical conductive engagement with jewelry to be cleaned, said insert being arranged to avoid direct electrical contact between said conductive engagement means and said tank;

a water reservoir within said housing;

a steam nozzle at said cleaning portion;

steam generating means for converting water introduced therein into steam for release through said steam nozzle and feeding means for selectively feeding water from said water reservoir into said steam generating means for generation of steam on demand, whereby an electrical current can flow through the jewelry being cleaned and said conductive engagement means and said conductive fluid in said tank and said tank when said conductive engagement means is electrically connected to said conductor and said tank, when filled with conductive fluid to allow electrolytic action between said tank and the jewelry to be cleaned and, subsequently, to allow remaining contaminants to be removed by means of steam by moving the jewelry from said tank into proximity with said steam nozzle issuing from said steam nozzle.

* * * * *